United States Patent [19]

Osarek et al.

[11] Patent Number: 4,928,717

[45] Date of Patent: May 29, 1990

[54] EQUIPMENT FOR SURFACE TREATMENT OF CONTINUOUSLY, RUNNING STRIPS PARTICULARLY PICKLING EQUIPMENT

[75] Inventors: Werner Osarek, Bochum; Franz G. Pempera, Neuwied; Dieter Schonert, Bochum, all of Fed. Rep. of Germany

[73] Assignee: Mannesmann AG, Duesseldorf, Fed. Rep. of Germany

[21] Appl. No.: 246,297

[22] PCT Filed: Aug. 28, 1987

[86] PCT No.: PCT/DE87/00393

§ 371 Date: Jun. 29, 1988

§ 102(e) Date: Jun. 29, 1988

[87] PCT Pub. No.: WO88/01657

PCT Pub. Date: Mar. 10, 1988

[30] Foreign Application Priority Data

Aug. 29, 1986 [DE] Fed. Rep. of Germany ..... 3629894

[51] Int. Cl.[5] ..... B08B 3/02; B08B 3/04; B08B 7/04

[52] U.S. Cl. ..... 134/64 R; 134/122 R

[58] Field of Search ..... 134/64 R, 64 P, 114, 134/122 R, 122 P; 68/181 R, 205 R

[56] References Cited

U.S. PATENT DOCUMENTS

| | | | |
|---|---|---|---|
| 2,418,386 | 4/1947 | Wood . | |
| 3,681,949 | 8/1972 | Fleissner | 68/181 R X |
| 4,270,317 | 6/1981 | Kurie | 134/64 R X |
| 4,592,784 | 6/1986 | Ghizzi | 134/64 R X |
| 4,647,173 | 1/1987 | Schar | 134/122 P X |

FOREIGN PATENT DOCUMENTS

| | | | |
|---|---|---|---|
| 0058216 | 8/1982 | European Pat. Off. . | |
| 1101903 | 3/1961 | Fed. Rep. of Germany . | |
| 0025027 | 2/1980 | Japan | 134/64 P |
| 7907239 | 3/1981 | Netherlands | 68/181 R |
| 436101 | 11/1974 | U.S.S.R. | 68/181 R |
| 460079 | 1/1937 | United Kingdom | 68/181 R |
| 1333943 | 10/1973 | United Kingdom . | |

*Primary Examiner*—Philip R. Coe
*Attorney, Agent, or Firm*—Ralf H. Siegemund

[57] ABSTRACT

The invention refers to an equipment for surface treatment of continuously running strip particularly pickling equipment wherein the strip runs longitudinally through a horizontally arranged container receiving treatment liquid while being closed by means of a lid. For optimizing such equipment particularly for improving the quality of treatment and for minimizing the period of time needed for treatment it is suggested to provide within the container a separate treatment channel (4) which is closed through an intermediate cover (6) and receives treatment medium through nozzle bars (9) and (10).

6 Claims, 3 Drawing Sheets

EQUIPMENT FOR SURFACE TREATMENT OF CONTINUOUSLY, RUNNING STRIPS PARTICULARLY PICKLING EQUIPMENT

BACKGROUND OF THE INVENTION

The invention relates to an equipment for surface treatment of continuously running strips particularly pickling equipment wherein the strip runs longitudinally through a horizontally arranged treatment channel which channel is arranged within a container enveloping the treatment channel and being closed by a lid; the treatment medium can be passed into the container, to and from the treatment channel.

Treatment equipment configured in such a manner are known under the name "Flat Pickling Systems" and today they are widely used. They have to a considerable extent replaced the earlier systems for "deep pickling". The treatment technique of continuously running strips could be improved considerably by means of flat pickling systems or horizontal pickling systems as compared with earlier technique since different concentration levels can be obtained in a better manner, the strip could be heated faster and an exchange of medium in the boundary phase between strip and treatment liquid could be activated. Also, ecological and economical advantages could be registered through reduction of the waste gas which is generated and through reducing the required thermal energy as well as through reduction of the flush water demand.

DESCRIPTION OF THE INVENTION

It is an object of the present invention to optimize known strip treatment equipment, particularly pickling equipment of the type referred to above, in order to shorten further the pickling process time and in order to improve the pickling quality of the stock being treated. For attaining this object equipment is suggested in accordance with the present invention which is characterized in that the treatment channel is bounded by the bottom of the container, by treatment channel side walls and by an intermediate cover, on all four sides; that run off troughs are formed between the side walls and the container inner walls which channels may receive simultaneously treatment medium being sprayed at the inlet and outlet side of the channel ends and through central openings provided in the side walls; and that the run off troughs are connected to a collecting chamber through which the treatment medium can be fed to a separately provided storage container.

The conception for the equipment underlying the invention has the advantage that a very low liquid level is used in the treatment channel. This makes sure that a better exchange of liquid obtains in the boundary phase strip/medium even without turbulence. If the treatment medium is sprayed in by nozzles at the inlet as well as the outlet side for the strip then in connection with the geometry and under support of lateral nozzles additional turbulence of the treatment medium obtains. The phase between the treatment medium and strip provides a better thermal transition between acid and strip and provides. therefore, for a better pickling effect. Thus the pickling period of time can be reduced and the throughput of the pickling can be improved.

The suggested device is also of advantage from the point of view of ecology and economy because owing to the advantages flowing from a turbulent flow one can run the equipment at a low pickling bath temperatures and energy can be saved accordingly. The lower temperatures and reduced energy consumption also reduces evaporation and gas formation so that emission into air is reduced. Also, waste water emission is reduced and because loading the waster water of the equipment is reduced owing to greater purity and smaller surface roughness of the strip.

The arrangement of the device and the utilization of an intermediate cover on the container lid permits rapid opening of the equipment in case of interference and easy access to the strip.

In accordance with a favorable feature of the invention it is suggested that on the inlet side, one set of nozzles (nozzle bar) is provided and two such sets (nozzle bars) are provided at the outlet side through which the treatment medium is sprayed at a shallow angle in relation to the strip whereby the sprayed treatment medium serves as a dynamic seal of the treatment channel. The medium sprayed into the treatment channel be it acid or lye, produces in the channel high turbulence whereby the larger flow component in the direction of strip movement is compensated in that in the discharge zone the two sets of nozzles act in the opposite direction.

In accordance with another favorable feature of the invention it is suggested to guide the strip above sliding and liquid guide elements arranged on the bottom of the treatment channel transversely to the direction of strip movement. This way one obtains rather high turbulence of the treatment medium even below the strip because strong currents and counter currents are generated between the slide and liquids guide elements. Simultaneously the slide elements support the strip so that it runs without sagging through the equipment in horizontal direction.

In accordance with another feature of the invention it is suggested to provide guiding elements or sheets within the treatment channel, at the side walls or near the side walls of the treatment channel, for guiding the treatment liquid flow at least approximately transversely to the strip. This guide equipment directs the treatment medium emerging from the sets of nozzles under high pressure into the treatment and in the desired direction therein. The conditions are supported by providing lateral nozzles transversely to the strip.

Preferably run-off troughs for the treatment medium are provided laterally outside of the treatment channel through which the treatment medium can be returned to the storage container. Owing to the continuous circulation between storage container and channel the amount of liquid needed is quite low providing also the advantage that the treatment medium can be discharged from the pickled area within a very short period of time and through the run off troughs in the container. This may be required in the case of in&reference such as rupture of the strip, so that the pickling area is rapidly accessible for removing the interference through the lid that can be opened very quickly.

DESCRIPTION OF THE DRAWINGS

An example of the invention is illustrated in the drawing and will be described as follows.

Herein is shown in Fig. 1 a cross section in longitudinal direction through the equipment in accordance with the invention.

Figure 1:
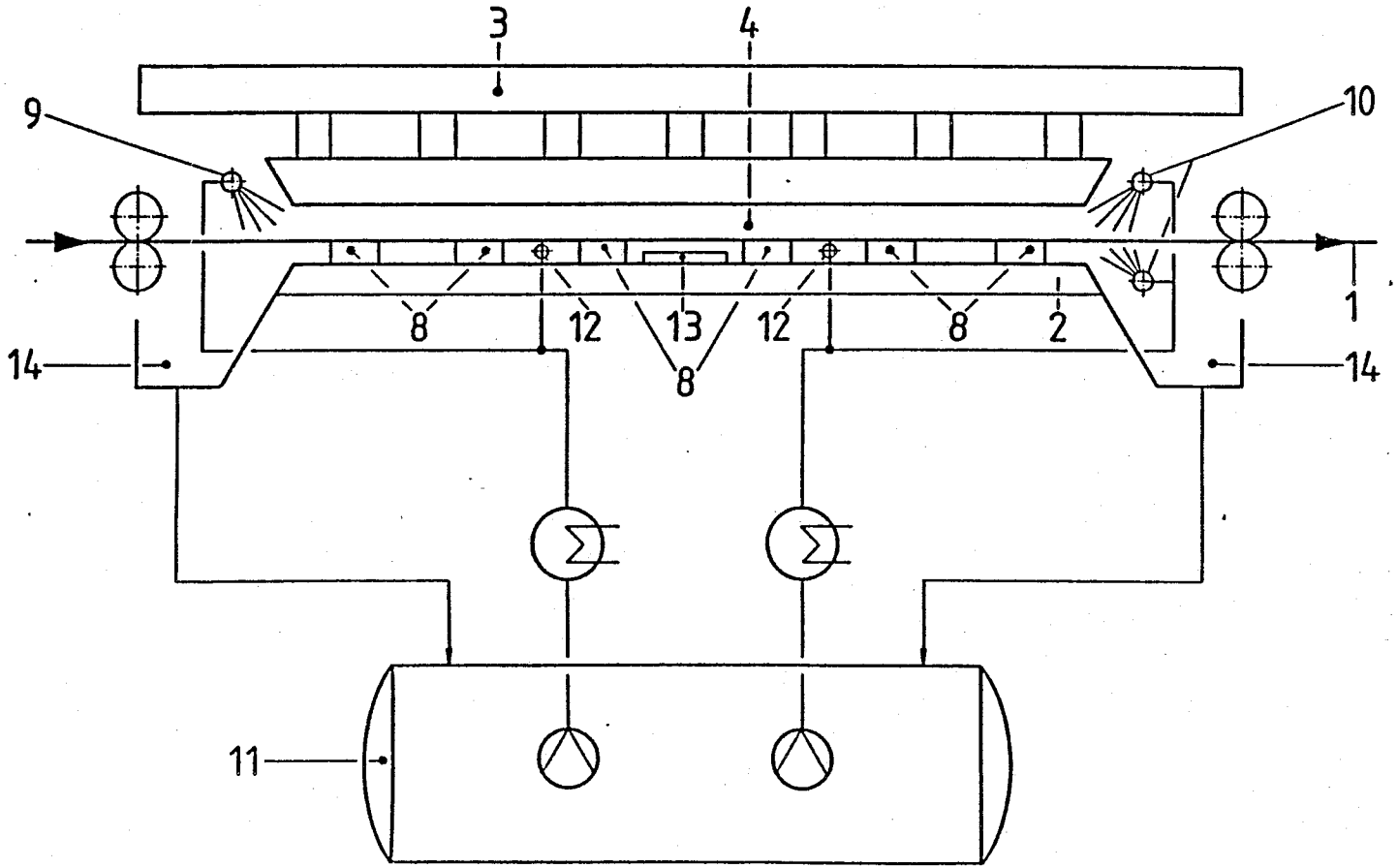
Figure 2:
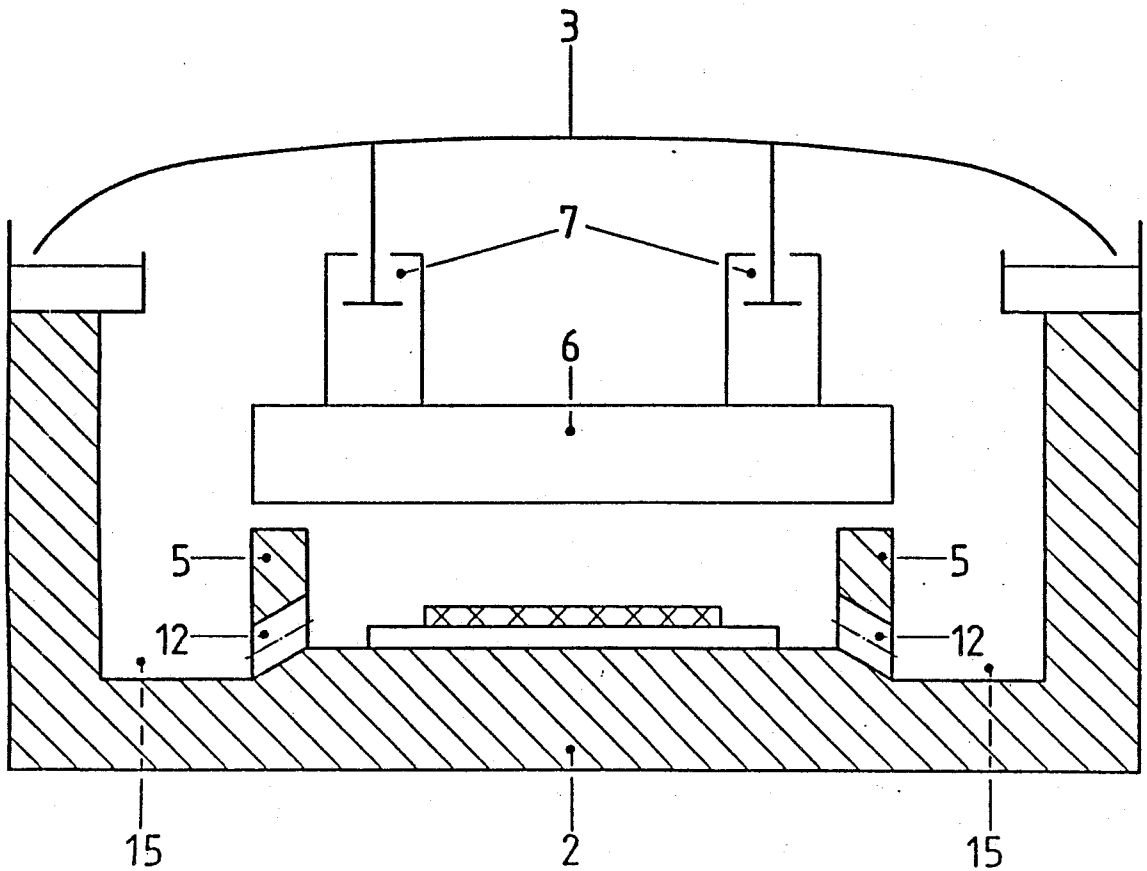
FIG. 2 is a cross section in the center of the treatment channel.
Figure 3:
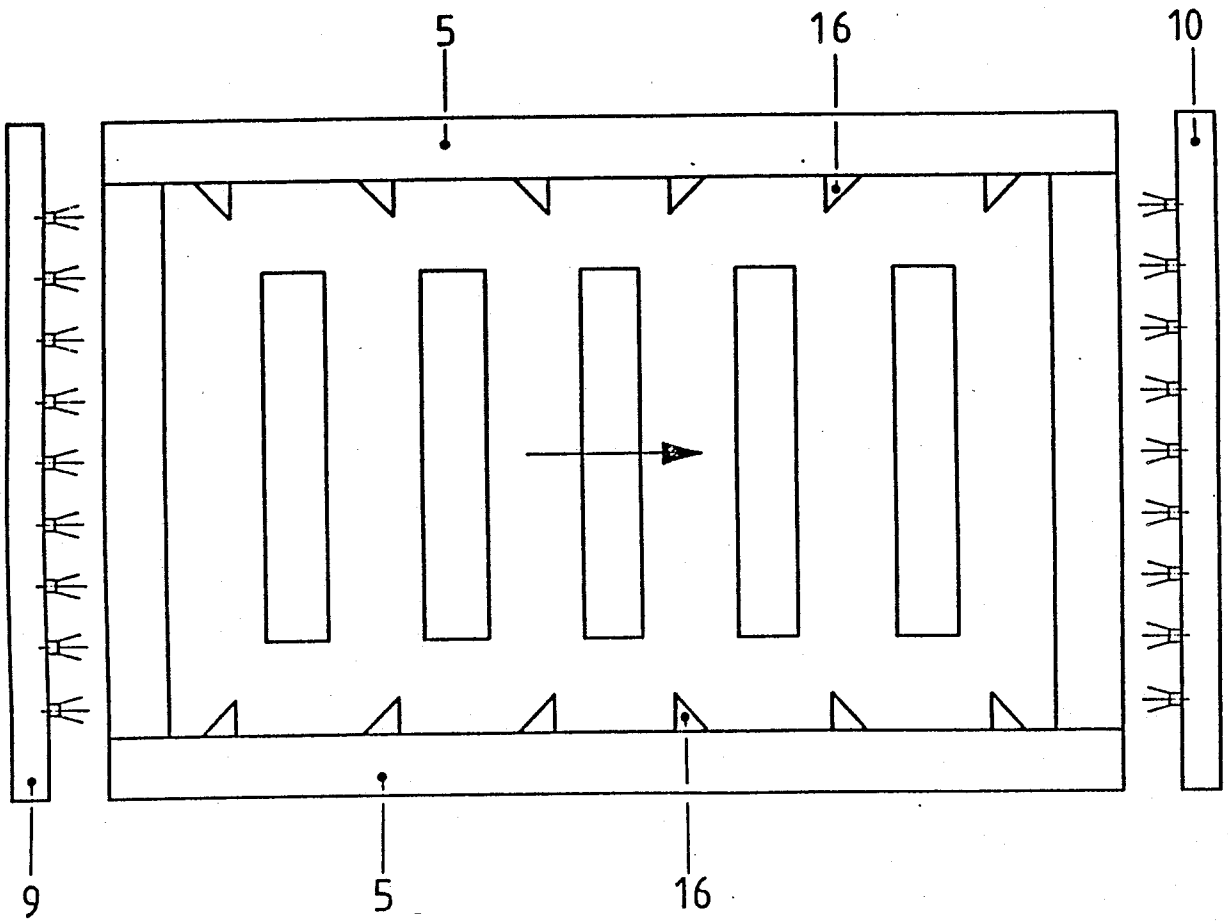
FIG. 3 is a top elevation of the equipment shown in Figs. 1 and 2.

The equipment is illustrated in a simplified fashion in the figures in order to explain the principle. Reference numeral 1 denotes the strip to be treated which runs through the equipment in the direction of the arrow. This equipment is comprised of a container 2 closed by a lid 3. As can be seen from FIG. 2 the lid is laterally sealed by means of a liquid seal. The inventive treatment channel is denoted with reference numeral 4 in FIG. 1 This channel is bounded by the bottom of the container, by the treatment channel side walls 5 as can be seen from FIG. 2 and by the intermediate cover 6 to provide boundary on four sides whereby the intermediate cover 6 can be adjusted as to height elevation and as shown by reference numeral 7 that cover 6 is suspended at the container lid 3. A small play may be provided between the treatment channel walls 5 and the intermediate cover 6.

Slide or liquid guiding elements 8 are provided in the bottom of the inventive treatment channel being arranged transversely to strip movement. On one hand these elements 8 support the strip 1 from below while serving for the formation of turbulence in the treatment liquid on the other hand. The treatment liquid is fed through the sets of nozzle bars 9 and 10 whereby one set of nozzles 9 is provided at the inlet side and two sets of nozzles (nozzle bars 10) are provided at the outlet side, the latter two sets 10 are respectively above and below the strip. The sets of nozzles receive treatment liquid by means of a pumping system from a storage container 11 This treatment liquid may in addition be fed immediately into the channel 1, in lateral direction as shown by reference numeral 12.

It can be seen that the nozzle set of the treatment medium as originating from the sets 9 and 10 are oriented at a shallow angle in relation to the strip whereby the direction is in the direction of strip movement as far as the set of nozzles 9 is concerned and against the movement of the strip as far as nozzles 10 are concerned. This way strong turbulence is set up within the treatment channel 4 which is enhanced in the lower area of the strip through the liquid guide elements 8. Owing to the highpressure of the liquid the treatment medium a dynamic seal is formed by the liquid itself in the inlet and the outlet zones of the treatment channels so that only a very small amount of treatment liquid runs back from that area into the collecting chambers 14. The chambers 14 are connected to run-off troughs 15 which are arranged laterally outside the treatment channels in the container and these troughs 15 receive treatment medium through the outlet 13 in the center of the treatment channel. The treatment medium flows from there through the return path back into the storage container 11.

As can be seen in the top elevation of FIG. 8 guide devices 16 can be provided laterally at the treatment channel side walls 5 through which the treatment medium flowing in from the nozzles 9 is guided transversely to the direction of strip movement. This way further desired turbulence is created obtained below the strip and between the glide and liquid glide stones.

We claim:

1. Equipment for surface treatment of continuously passing strips, particularly pickling equipment wherein the strip runs in longitudinal direction through a horizontally arranged closed treatment channel, said treatment channel being arranged in a container enclosing the treatment channel, and further including a lid closing the container, the container provided for receiving the treatment medium being passed into and out of the treatment channel, the channel having an inlet and an outlet, the improvement comprising said treatment channel being bounded by a bottom of the container, by two inner walls of the container arranged on the bottom and constituting treatment channel walls, as well as by an intermediate cover;

run off troughs established between the two inner walls and outer walls of the container, for receiving treatment medium;

openings provided in the treatment channel walls;

means for simultaneously spraying the treatment medium at the inlet and the outlet of the treatment channel, and through said openings;

a collection chamber, and a separately provided storage container; and means for connecting the run-off troughs to the collection chamber through which the treatment medium can be fed to the separately provided storage container.

2. Equipment as in claim 1, said intermediate cover being fastened to the container lid and rests with play on the two inner walls.

3. Equipment as in claim 1 further including three nozzle bars for the treatment medium, one of said bar of nozzles being provided at said inlet, two others of said nozzle bars being provided at the outlet.

4. Equipment as claim 1 characterized in that the strip is guided above the bottom of the treatment channel by means of slide and liquid guide elements being arranged for extending transversely to the movement of the strip.

5. Equipment as in claim 1 further comprising guide elements within the treatment channel either on or adjacent to the inner walls of the treatment channel said guide elements being provided transversely to the strip, for guiding a stream of the treatment liquid.

6. Equipment as in claim 1 further including nozzles being provided as pulse sources for inducing turbulence underneath the strip, into the treatment medium.

* * * * *